US005875570A

United States Patent [19]

Sartor

[11] Patent Number: 5,875,570

[45] Date of Patent: Mar. 2, 1999

[54] SKI BOOT COMPRISING A SHELL AND A BOOT LEG WHICH ARE HINGED TO EACH OTHER, WHEREIN THE BOOT LEG IS FORMED IN TWO PORTIONS WHICH CAN BE SPREAD APART FROM EACH OTHER

[75] Inventor: Mario Sartor, Vemegazzú , Italy

[73] Assignee: Tecnica S.p.A., Treviso, Italy

[21] Appl. No.: 912,238

[22] Filed: Aug. 15, 1997

[30] Foreign Application Priority Data

Sep. 20, 1996 [IT] Italy ..... TV9600059 U

[51] Int. Cl.[6] ..... A43B 5/00

[52] U.S. Cl. ..... 36/118.2; 36/118.7; 36/118.8

[58] Field of Search ..... 36/117.1, 118.2, 36/118.3, 118.4, 118.7, 118.8, 118.9

[56] References Cited

U.S. PATENT DOCUMENTS

| | | | |
|---|---|---|---|
| 4,539,764 | 9/1985 | Pradier | 36/118.7 |
| 5,005,303 | 4/1991 | Bonaventure et al. | 36/118.7 |
| 5,127,171 | 7/1992 | Stampacchia | 36/118.9 |
| 5,553,402 | 9/1996 | Marega et al. | 36/118.2 |
| 5,718,066 | 2/1998 | Chemello et al. | 36/117.1 |

FOREIGN PATENT DOCUMENTS

| | | | |
|---|---|---|---|
| 371915 | 6/1990 | European Pat. Off. | 36/118.2 |
| 2663515 | 12/1991 | France | 36/118.7 |

*Primary Examiner*—M. D. Patterson

*Attorney, Agent, or Firm*—Griffin, Butler Whisenhunt & Szipl, LLP

[57] ABSTRACT

A ski boot comprising a shell and a boot leg hinged to each other, wherein the boot leg is produced in a front and a rear portion that can be spread apart from each other. The front portion of the boot leg is subdivided into two side pieces that define an opening for the introduction of a skier's foot, while at the rear they are connected by a panel, hinged at the bottom to the side pieces. Cams are associated with the panel and the side pieces, the cams being displaceable on the side pieces and connected eccentrically to the rear panel. The cams can be arranged in a position in which the panel is brought close to the side pieces. The cams can also be arrange in another position in which the panel is distanced from the side pieces.

9 Claims, 5 Drawing Sheets

SKI BOOT COMPRISING A SHELL AND A BOOT LEG WHICH ARE HINGED TO EACH OTHER, WHEREIN THE BOOT LEG IS FORMED IN TWO PORTIONS WHICH CAN BE SPREAD APART FROM EACH OTHER

The present invention relates to a ski boot of the type comprising a shell and a boot leg which are hinged to each other. On the boot leg there are provided means for closing and locking the latter, generally of the lever type.

The boot leg is formed by a first and a second portion, respectively front and rear, which can be spread apart from each other. This configuration and characteristic of the boot leg are such that, independently of the forward locked position or the "walking" position of the boot leg, the latter can be readjusted from time to time to the size of the calf of the user and therefore render the use of the boot comfortable.

Ski boots in which the boot leg is produced in two portions which can be spread apart from each other for the above-mentioned purpose are already known. European Patent Application No. 0438079 of Nordica Spa may be cited for example. The subject of this application, as is clear from its title, is a rear support device, particularly for ski boots. It is composed in a known manner, in the upper part, of a boot leg hinged at the bottom to the shell of the boot and having at the rear an opening which receives a support plane, which, together with the boot leg, constitutes a space to receive the calf of the user. The said support plane, which can be associated with the boot leg or with the shell, can rotate with respect to one or the other, forwards or backwards about its lower end. To control such a movement, an eccentric lever is provided which engages the said support plane and can rotate in a vertical plane about a transverse axis. The eccentric lever can assume two end operating positions corresponding respectively to the inclined plane position inclined fully forwards (skiing position) or inclined fully backwards (position for walking). When the lever is in the second position of the support plane, the inclination can be modified to make it ideal and conforming to the dimensions of the calf of the user. This solution, although it petforms the task assigned to it, has the considerable drawback of being complex in construction and difficult to control in the displacements, so that it is definitely inconvenient to use.

A further example of a known solution, forms the subject of European Patent Application No. 0502795 in the name of Skis Rossignol SA. This application, as is clear from its title, concerns a ski boot with shell and collar. More particularly, the subject of the patent application is a ski boot comprising a shell to receive the foot and the lower portion of the leg of the skier, and also a deformable collar hinged to the said shell and provided to surround and receive the lower part of the leg. The said collar comprises, on its front part, appendages which overlap each other and are intended to co-operate with levers for closing and locking the boot. The collar has at the rear a wide opening to which there is applied at the rear a rigid covering element hinged to the shell and intended to close the said opening of the collar. In the position of use, the rear covering element engages with the collar and is kept in engagement against the latter by a closure member, for example of the locking type. This type of solution is also complex to produce and inconvenient to use when the position of the rear covering element has to be modified in order to vary the section of the boot leg which receives the calf of the user.

Another example of a solution of the prior art is provided by what forms the subject of U.S. Pat. No. 4,677,770 in the name of Salomon SA. The ski boot which is the subject of that patent comprises, in a known manner, a rigid base shell on top of which is mounted a boot leg. The latter is sub-divided into a front portion and a rear portion, and in particular the rear portion is displaceable with respect to the front portion to allow the introduction and withdrawal of the foot of the skier into and from the boot.

A device for closing the boot leg is also provided which comprises a cable that surrounds the front and rear portions of the boot leg and is subject to the action of a tightener integral with one of the lateral walls from the front part of the boot leg, while on the other lateral wall of the latter a toothed portion is provided to grip the aforesaid connecting cable, thus closing or bringing together the front and rear portions of the boot leg and holding them against the leg of the skier when the tightener acts on the tensioning cable. This is substantially a device for adjusting the closure of the boot leg, that is to say, the bringing of the front part close to or away from the rear part, actuated precisely by means of the aforesaid cable and the related adjustable tightener.

This solution has the same drawbacks as the previous ones and more precisely is difficult to adjust when the connecting cable is to be hooked to the toothed portion mentioned above. The subject of U.S. Pat. No. 5,107,609 of Nordica Spa is a ski boot, the structural characteristics of which resemble, in their essential lines, to those of the above-mentioned European Patent No. 0438079 of Nordica Spa. This boot also has, in the rear portion of the boot leg, a flat element or plate that can be variably inclined with respect to the boot leg in order to modify the space receiving the lower part of the leg of the skier, that is to say, the calf. In this case also, the aforesaid plate is obtained by shaping of the shell of the boot or of the boot leg, or is connected to hinging means on the said shell or the said boot leg. More precisely, the means for adjusting the inclination of the plate with respect to the boot leg are constituted by a tensioning and/or adjusting element, such as, for example, a vertical lever or a circular winding device which tensions at least one tension element, for example a cable. In this boot, in particular as regards the means for modifying the inclination of the plate as specified above, such means are the result of complex construction and assembly and their adjustment is inconvenient and difficult.

There has now been designed, and forms the subject of the present invention, a ski boot in which the boot leg is produced in two portions, respectively front and rear, which can be spread apart from each other, and which allows the drawbacks of the solutions of the prior art to be overcome. One of the principal objects of the present invention therefore consists in providing a ski boot in which the spreading apart of the front and rear portions of the boot leg is actuated by means which are extremely simple and are actuated immediately, without their adjustment requiring complex and inconvenient operations by the user.

Another object of the present invention is to provide a ski boot in which the spreading apart of the front and rear portions of the boot leg of the boot is effected by means of a single, simple operation of actua-tion of cam means which act in combination on the said front and rear portions of the boot leg, bringing them together or away from each other in a simple and effective manner. The subject of the present invention is therefore a ski boot of the type comprising a shell and a boot leg which are hinged to each other, there being provided on the boot leg means for closing and locking it, the boot leg being formed by in a first and a second portion, respectively front and rear, which can be spread apart from each other, characterized in that the said front portion of the boot leg is sub-divided into two side pieces which at the front define the opening for the introduction of the foot of the skier, while at the rear they are connected by a rear portion or panel, the latter being hinged at the bottom to the said side pieces of the boot leg, there being provided between the said rear panel and each side piece cam means connected eccentrically to the said rear panel displaceable with respect to the said side piece between a first position in which, owing to the said eccentric connection and the said displacement, they bring the said rear panel close to the said side piece, and a second position in which still owing to the said eccentric connection and the said displacement, they move the said panel away from the said side piece.

The characteristics and the advantages of the ski boot according to the present invention, and more particularly of its boot leg in two portions that can be spread apart, as well as of the means which control their movement close to and away from each other, will be revealed by the following detailed description of a non-limitative embodiment thereof, made with reference to the accompanying Figure, in which.

Figure 3:
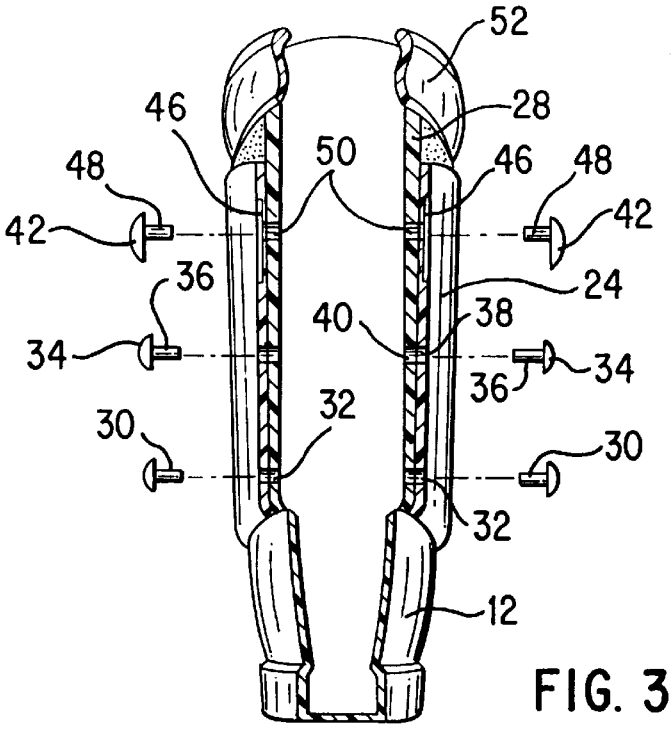
FIG. 3 is a view of the boot of the present invention according to the section A—A in FIG. 1.
Figure 5:
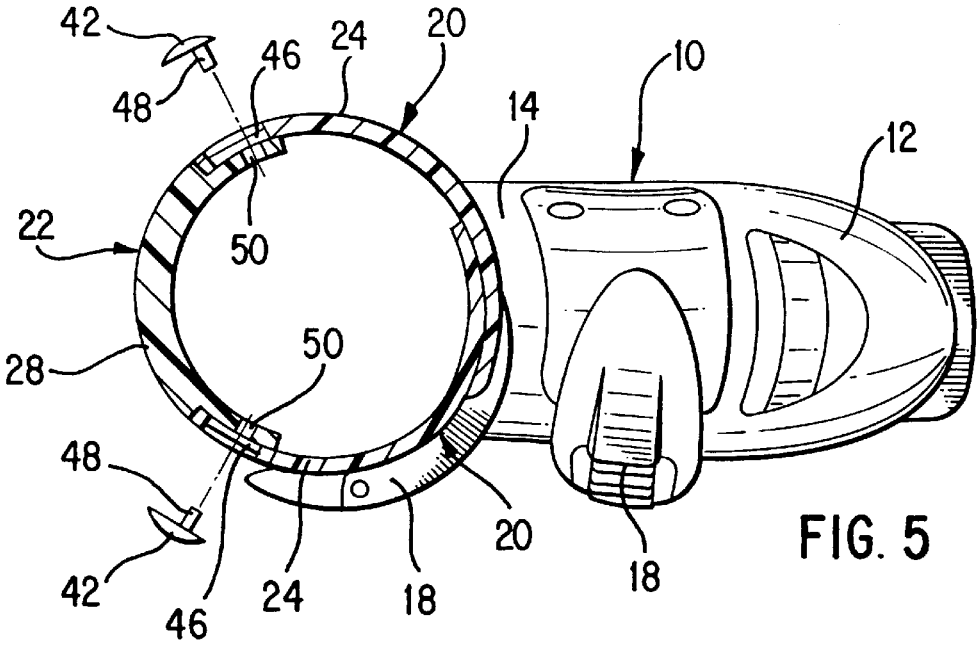
FIG. 5 is a view of the boot of the present invention according to the section B—B in FIG. 1.
Figure 6:
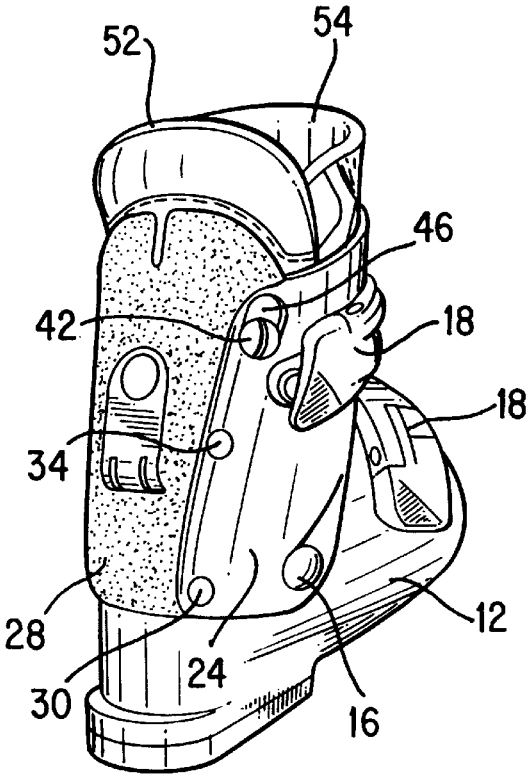
FIG. 6 is a substantially rear view of the boot according to the present invention.

Before passing to the detailed description of the exemplary embodiment of the boot according to the invention, it should be stated that the boot has been shown, and will consequently be described, with reference to only one side, with the exception of FIGS. 3 and 5, since the whole structure of the boot is symmetrical with respect to a longitudinal axis. In fact, what is described in connection with one side of such a boot, it should apply equally to the opposite side.

Figure 1:
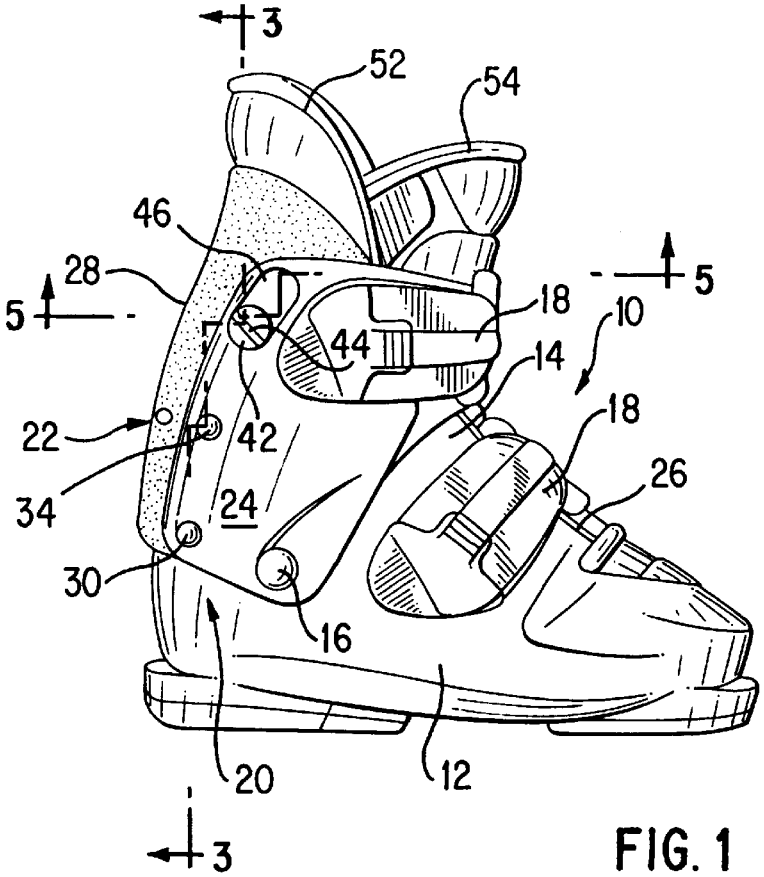
FIG. 1 is a diagrammatic side view of the boot according to the present invention, wherein the operating means for the spreading apart of the portions of the boot leg are not actuated.

Firstly, referring particularly to FIG. 1, it can be seen that the ski boot according to the present invention, indicated as a whole by 10, is of the type comprising a shell 12 and a boot leg 14 which extends above the shell 12.

The boot leg 14 is hinged, in a known manner, to the shell 12 by means of a pin 16 which allows the boot to assume the two known operating positions corresponding to skiing (which is that shown in FIG. 1) and that for walking (not shown) in which the boot leg 14 is opened, allowing the user to keep the legs substantially vertical.

The boot leg 14 is provided in a known manner with means 18 for closing and locking the latter which, in FIG. 1, are shown in the closed position. The means 18 are generally of the type with locking lever of a known type and are therefore not described in detail.

The boot leg 14 is formed by a first and a second portion, respectively front 20 and rear 22 which, according to one of the characteristics of the boot according to the present invention, can be spread apart from each other, and more precisely in a mutually adjustable position, independently of whether the boot is in the condition of FIG. 1 (corresponding to skiing) or in the condition corresponding to walking, that is to say, with the closure and locking means 18 disactivated (not shown).

As can be seen in particular in FIG. 1, but refer-ring also to the remainder of the accompanying Figures, the front portion 20 of the boot leg 14 is sub-divided into two side pieces 24 which at the front define the opening 26 for the introduction of the foot of the skier, while at the rear they are connected to each other by a rear panel 28.

As can be still seen from the accompanying Figures, the aforesaid side pieces 24 partially overlap the rear panel 28, and the latter in particular, as will be revealed more clearly hereinafter, constitutes the movable element of the boot leg for the spreading apart thereof, that is to say, its displaceable part, since the aforesaid side pieces 24 are stationary as part of the boot leg 14. The side pieces 24 and the rear panel 28 are expediently connected to one another, and with them there are associated cam means, described hereinafter, the actuation of which is such as to control displacements of the rear panel 28 with respect to the side pieces 24 so as to bring the former close to or away from the latter.

First of all, the rear panel 28 is hinged at the bottom to the side pieces 24 by means of a pair of pins 30 (both visible in FIG. 3) which are introduced into corresponding holes 32 in the panel 28 and in the side pieces 24. This type of connection allows in particular the rotation of the entire panel 28 about its lower end in both possible directions of rotation, as is particularly clear from FIGS. 1 and 3.

The panel 28 and the side pieces 24 are also connected to one another by means which guide the rotation of the panel 28 with respect to the side pieces 24. Such means comprise a pin and slot connection wherein, in the exemplary embodiment under consideration, the pin 34 is arranged on the side piece 24 and its shank 36 projects in the direction of the panel 28 and is first introduced into a slit or slot 38 in the side piece 24, and then into a hole 40 in the panel 28. The slot 38 is more clearly visible in the cut-away region of FIG. 4, from which it will be noted that the said slot 38 extends transversely on the side piece 24 in the direction of the rear panel 28. In this way, when the said panel 28 is caused to rotate in one direction or the other, the shank 36 of the pins 34 can slide freely in the said slot 38, thus allowing the rotational displacements of the panel 28.

The ski boot according to the present invention further comprises cam means associated with each side piece 24 and with the rear panel 28, a portion of which, arranged so as to be displaceable in the side piece 24, is actuated directly by the user, there being associated with said portion a further portion cooperating with the rear panel which, when the portion arranged in the side piece 24 is actuated, controls the displacements of the rear panel 28.

As can be seen from the accompanying Figures, said cam means comprise firstly a first portion, arranged in the side piece 24 and displaceable therein, which is essentially constituted by a disc-like element 42 provided, on the visible face, with a recess 44 and which is received in a slot 46 provided in the side piece 24.

Figure 14:
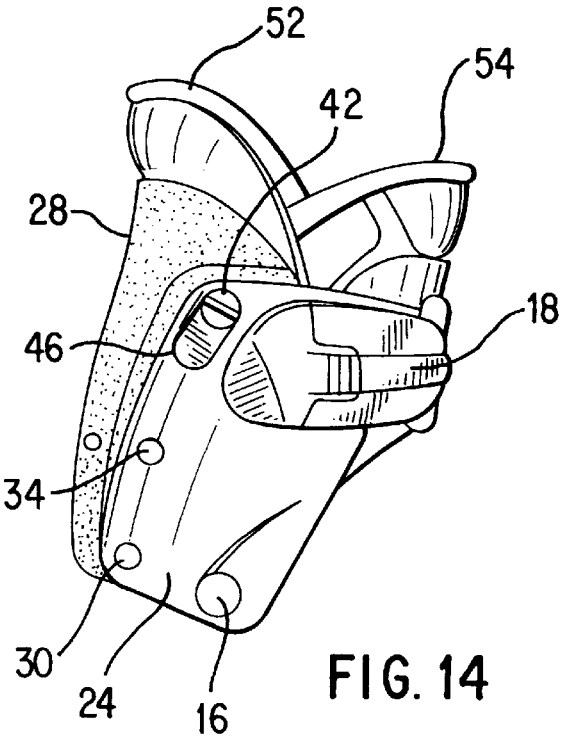
FIG. 14 is a view analogous to FIG. 12, showing the final step in the spreading apart of the portions of the boot leg.

The slot 46 is substantially rectangular in shape and has two rectilinear sides which are parallel and inclined upwards towards the front part of the boot and which are connected to each other at the ends by curved segments, in particular of essentially semicircular profile so as to receive the disc-like element 42, as can be seen in particular from FIG. 1 and from the other analogous Figures illustrating the boot substantially in the same view, as well as from FIG. 14.

According to one of the characteristics of the boot according to the present invention, the disc-like element 42, which can be considered as an actuating button, can be caused to rotate in the slot 46 and simultaneously displaced longitudinally along the latter. It is sufficient, using any known tool such as a screwdriver or the like, to insert the head of the screwdriver into the recess 44 of the disc-like element 42 and to bring about its rotation. The latter, owing to the particular configuration of the slot 46, takes place along a substantially central axis of the disc-like element 42 while by means of the same tool a longitudinal displacement of the said disc-like element 42 is effected.

This displacement in particular may be such as to bring the disc-like element 42 from one end of the slot 46, as shown in FIG. 1 and in the analogous Figures, to the other end, as can be seen in FIG. 14, completing a rotation of 180°.

According to a further advantage and characteristic of the boot according to the present invention, the disc-like element 42, during the aforesaid movement in translation, can be arrested in an intermediate position in the slot 46, the function of which will be described hereinafter.

As can now be seen in particular from FIGS. 3 and 5, the disc-like element 42 is provided, on one of its faces, with a pin 48 substantially perpendicular to the body of the disc-like element 42 and, according to one of the principal characteristics of the boot according to the present invention, arranged eccentrically with respect to the aforesaid disc-like element 42.

As can be seen still with particular reference to FIGS. 3 and 5, the rear panel 28 is provided, at the level of the slot 46, with a hole 50 capable of receiving the pin 48 when the disc-like element 42 is arranged in the slot 46. In this way, the disc-like element 42 and its pin 48 produce an eccentric connection between each side piece 24 and the rear panel 28.

The operation of the boot according to the present invention, in particular with regard to the spreading apart of its boot leg 14, is as follows.

Let it be assumed that it starts from the condition in FIG. 1, in which the rear panel 28 is in its position closest to the side pieces 24 so that tno spreading apart of the boot leg 14 is occurs. In this condition, the ends of two padded portions 52, 54 of the boot leg 14, of which the portion 52 is integral with the panel 28, while the portion 54 is in one piece with the boot leg 14 and is therefore stationary, are at the minimum possible distance relative to each other.

Figure 2:
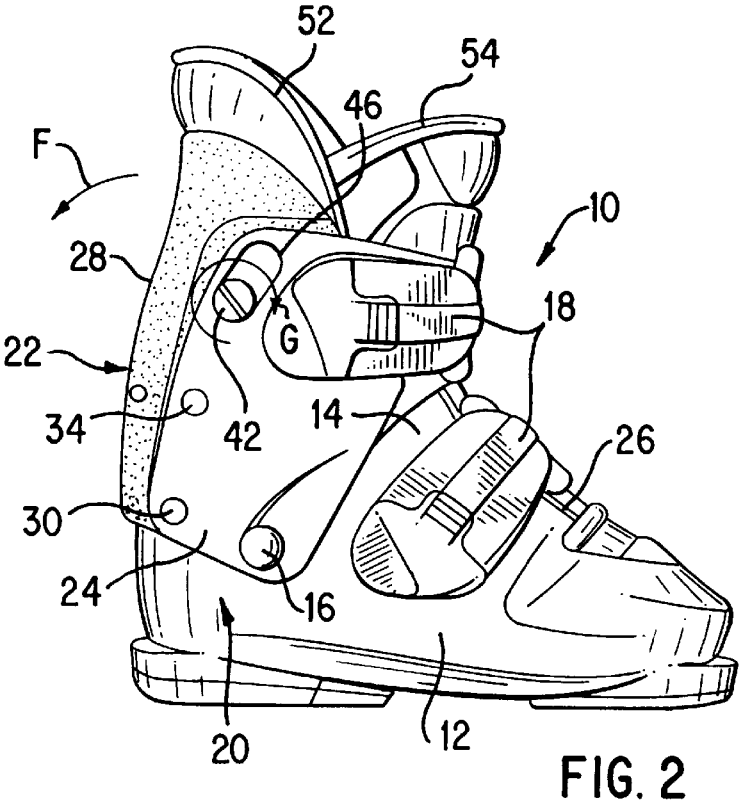
FIG. 2 is a view analogous to FIG. 1, wherein the said operating means are actuated.
Figure 4:
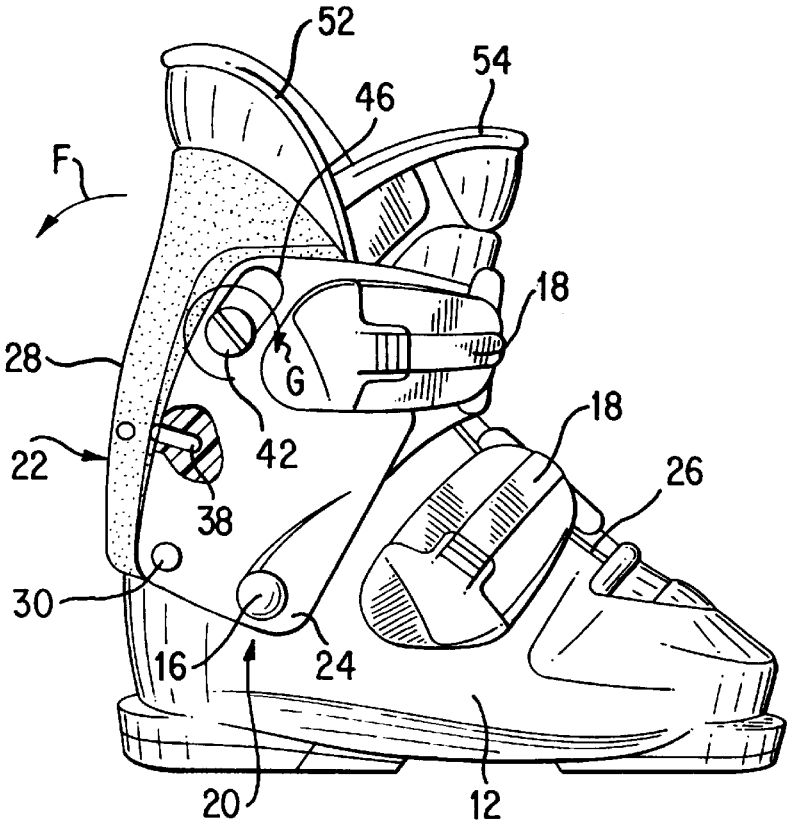
FIG. 4 is a view analogous to FIGS. 1 and 2, which is partly cut away to show in detail one of the operating means for the spreading apart of the portions of the boot leg.

Wishing now to bring about the spreading apart of the boot leg 14, that is to say, to achieve backward rotation as indicated by the arrow F in FIGS. 2 and 4, of the rear panel 28 and therefore also to allow the backward rotation of the padded portion 52, it is sufficient to use any tool on the disc-like element 42 to cause it to rotate in a clockwise direction as indicated by the arrow G, still in FIGS. 2 and 4.

At the same time an action is carried out such as to cause the disc-like element 42 to slide in the slot 46 in such a way that, owing to the eccentric connection of the pin 48 of the said disc-like element 42, the said pin 48, owing to the rotation and the translation of the disc-like element 42, will bring about the backward rotation of the rear panel 28, bringing it, for example, into the condition shown in FIG. 4.

The aforesaid backward rotation is allowed both by the hinging by means of the pins 30 of the panel 28 to the side pieces 24, and by the pin 34/slot 38 connection between the side pieces 24 and the panel 28.

The amplitude of the backward rotation of the panel 28 depends on the nature of the rotation and the movement in translation imparted to the disc-like element 42, which will then expediently transmit a backward pushing action by means of its pin 48. The action now described of course takes place on both sides of the boot leg, so that ultimately the said action is distributed in a uniform and balanced manner.

It is recalled that the spreading apart of the boot leg 14 can be achieved both with the boot in the skiing condition (that is to say, with the closure and locking means 18 closed) and with the boot in the walking condition (that is to say, with the closure and locking means 18 disabled).

Once the spreading apart is no longer required, obviously depending on the size of the calf of the user, the boot can be returned to the starting condition, that is to say, that shown in FIG. 1, by operating in the opposite direction to the preceding direction.

It will nevertheless be sufficient then to impart to the disc-like element 42 a translation movement translation which is opposed to the previous one and a rotation also in the opposite direction to that imparted previously, that is to say, in the direction of the arrow G. Finally, a forward rotation of the panel 28 will be obtained, which will be followed in this movement by the padded portion 52 until the boot leg 14 is returned to the initial condition from which it started.

Consideration will now be given in particular to FIGS. 7, 9, 11, 13 and 15, which illustrate the method of operation of the boot for the spreading apart of its boot leg, particularly as regards the actuation of the cam means mentioned above.

Figure 7:
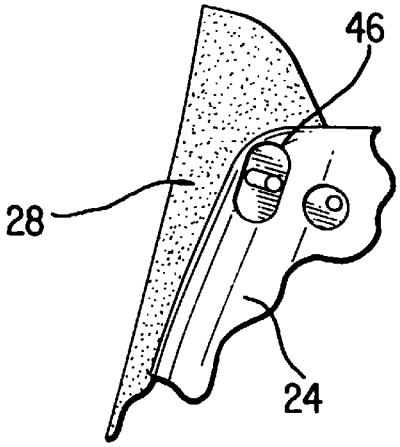
FIG. 7 is a view on an enlarged scale of a detail showing an operating step of the spreading apart of portions of the boot leg.
Figure 8:
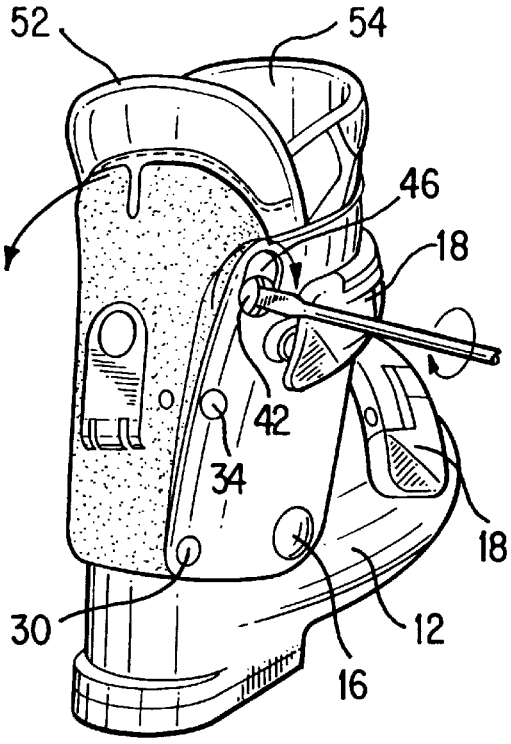
FIG. 8 is a view analogous to FIG. 6, showing the actuation of the operating means for the spreading apart of the portions of the boot leg.
Figure 9:
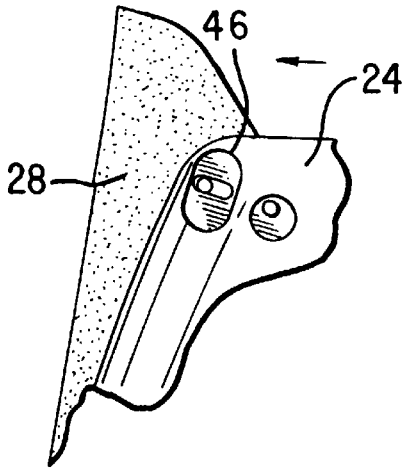
FIG. 9 is a view on an enlarged scale showing the actuation of the operating means for the spreading apart of the portions of the boot leg in the condition in FIG. 8.
Figure 10:
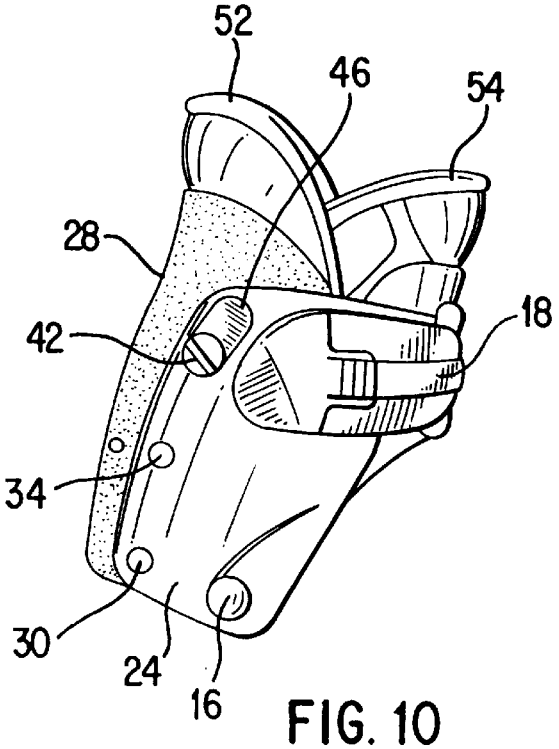
FIG. 10 is a partial side view of the boot according to the present invention, showing the start of the operating step of spreading apart of the portions of the boot leg of the boot.
Figure 11:
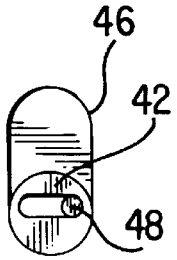
FIG. 11 is a diagrammatic view on an enlarged scale, showing a part of the operating means which effect the spreading apart of the boot leg in the condition of FIG. 10.
Figure 12:
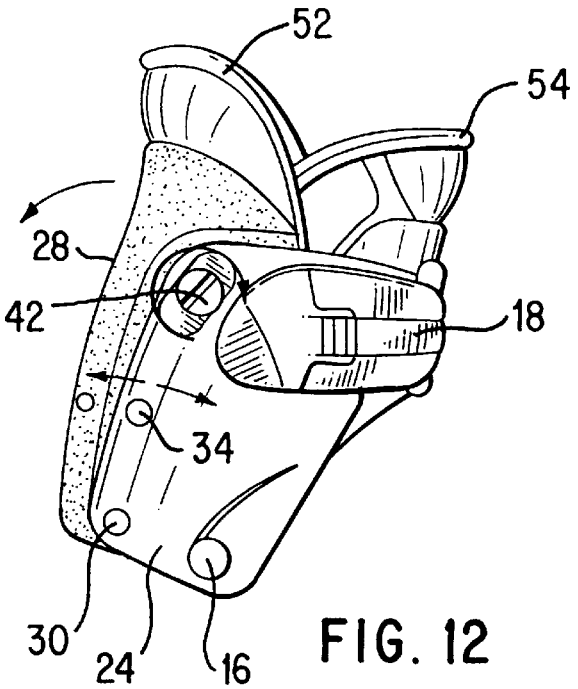
FIG. 12 is a view analogous to FIG. 10, showing an intermediate step in the spreading apart of the boot leg.
Figure 13:
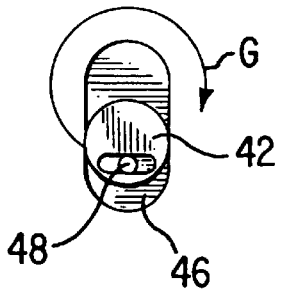
FIG. 13 is a view on an enlarged scale showing a part of the operating means for the spreading apart of the boot leg in the condition of FIG. 12.
Figure 15:
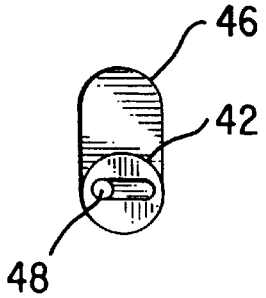
FIG. 15 is a view of a part of the operating means for the spreading apart of the boot leg in the condition of FIG. 14.

FIGS. 7 and 9 respectively show more precisely two possible positions of the disc-like element 42, in the first of which (FIG. 7) the panel 28 is in the position closest to the side piece 24, while in the second (FIG. 9) the panel 28 has been moved back with respect to the side piece 24 owing to the action of the cam means with which the boot according to the present invention is provided. FIGS. 11, 13, and 15 are views analogous to FIGS. 7 and 9, which represent the cam means of the boot according to the present invention in the different successive operating positions. More precisely, in the condition in FIG. 11, the cam means mentioned above are arranged so as to maintain the panel 28 in the position closest to the side pieces 24. In FIG. 3, by means of rotation still in the direction of the arrow G, the disc-like element 42 is caused to rotate to bring about the backward rotation of the panel 28 as indicated diagrammatically in FIG. 12. Finally, in FIG. 15, the rotation of the disc-like element 42 ends, so that the panel is in the position of maximum spreading apart with respect to the side piece 24, as illustrated diagrammatically in FIG. 15. FIGS. 11, 13 and 15 show diagrammatically in succession in the various operating positions the pin 48 with which the disc-like element 42 is provided.

As described above, the extreme simplicity of construction and operation of the means which control the spreading apart of the boot leg of the boot according to the present invention is evident, particularly as regards the cam means described above and constituted substantially by the disc-like element 42 and the pin 48 associated therewith.

Considering what is described above, it may reasonably be stated that the cam means mentioned above function as a control lever which transmits the movement to the panel 28 from the disc-like element 42. The latter in particular is comparable to the fulcrum of the aforesaid lever and in particular is a movable fulcrum in so far as during the operating step of displacement of the panel 28, the latter is caused to rotate and to move in translation in the slot 46. This clearly applies both in the step of actual spreading apart of the boot leg of the boot and in the step of returning the latter to the initial condition.

Finally, it is clear that variations and/or modifications may be applied to the ski boot according to the present invention without thereby departing from the scope of protection of the invention itself.

I claim:

1. A ski boot comprising a shell and a boot leg which are hinged to each other, there being provided on the boot leg, means for closing and locking the boot leg, wherein the boot leg is formed by a front portion and a rear portion which can be spread apart from each other, characterized in that said front portion (20) of the boot leg (14) is sub-divided into two side pieces (24) which at the front define the opening (26) for the introduction of the foot of the skier, while at the rear they are connected to each other by a rear panel (28), the latter being hinged at the bottom to the said side pieces (24) of the boot leg (14), cam means being associated to said side pieces (24) and the said rear panel (28) and being connected eccentrically to the said rear panel (28), a portion (42) of which cam means is constituted by a substantially circular flat element (42) which is provided with a pin (48) which extends eccentrically and perpendicularly with respect to the body of said substantially circular flat element (42), and is inserted in a hole (50) in the rear panel (28), while said substantially circular flat element (42) is simultaneously received in said slot (46) in the said side piece (24) and is displaceable in a seat (46) of the said side piece (24) between a first position in which it brings said rear panel (28) close to said side piece (24), and a second position in which it moves said rear panel (28) away from the said side piece (24).

2. The ski boot of claim 1, wherein a displacement of said substantially circular flat element (42) in the slot (46) comprises at least its rotation about a substantially central axis thereof, and a displacement of said element (42) along the longitudinal axis of the slot (46).

3. The ski boot of claim 2, wherein said substantially circular flat element (42) can be actuated.

4. The ski boot of claim 3, wherein said substantially circular flat element (42) has, on its visible face, at least one recess or notch (44) capable of allowing engagement with a conventional actuating tool.

5. The ski boot of claim 1, wherein said slot (46) is substantially rectangular in shape, having at least one pair of substantially curved opposite sides into which said substantially circular flat element (42) is introduced at the end of its operating strokes for bringing the rear panel (28) close to and away from the front side pieces (24) of the boot leg (14).

6. The ski boot of claim 5, wherein the remaining two sides of the slot (46) are substantially rectilinear and parallel to each other.

7. The ski boot of claim 6, wherein said rectilinear sides, substantially parallel to each other, of the slot (46) are inclined upwards and forwards with respect to side piece (24).

8. The ski boot of claim 3, wherein said pin (34) and slot (38) connection is arranged in an intermediate region between said cam means and the pin (30) which hinges the rear panel (28) to the side piece (24).

9. The ski boot of claim 1, wherein between the said rear panel (28) and each side piece (24) a pin and slot connection (34–38) is provided to guide the rotation of said rear panel (28) with respect to said side piece (24).

* * * * *